US005762416A

United States Patent [19]

LeSire

[11] Patent Number: 5,762,416

[45] Date of Patent: Jun. 9, 1998

[54] MIXING UNIT

[76] Inventor: James R. LeSire, 4526 Marlborough Dr., San Diego, Calif. 92116

[21] Appl. No.: 774,952

[22] Filed: Dec. 27, 1996

[51] Int. Cl.[6] ..... B01F 13/00

[52] U.S. Cl. ..... 366/136; 366/163.2

[58] Field of Search ..... 366/131, 134, 366/136, 137, 163.2, 163.1, 191, 173.1; 137/599, 601, 602, 890, 892, 599.1

[56] References Cited

U.S. PATENT DOCUMENTS

| | | | |
|---|---|---|---|
| 2,017,867 | 10/1935 | Nantz | 366/163.2 |
| 3,166,020 | 1/1965 | Cook | 366/137 |
| 3,194,539 | 7/1965 | Hanne-Wiame | 366/173.1 |
| 3,337,192 | 8/1967 | Eftathiou | 366/163.1 |
| 3,565,404 | 2/1971 | Reid | 366/137 |
| 3,643,688 | 2/1972 | Meinert | 137/556 |
| 3,886,972 | 6/1975 | Scott et al. | 137/602 |
| 4,007,921 | 2/1977 | Zingg | 366/136 |
| 4,100,614 | 7/1978 | Mandt | 366/163.2 |
| 4,186,772 | 2/1980 | Handleman | 137/604 |
| 4,289,732 | 9/1981 | Bauer et al. | 366/173.1 |
| 4,498,819 | 2/1985 | El-Saie | 406/181 |
| 4,519,899 | 5/1985 | Oertle et al. | 208/179 |
| 4,571,088 | 2/1986 | Frensch et al. | 366/136 |
| 5,018,871 | 5/1991 | Brazelton et al. | 366/168 |
| 5,067,508 | 11/1991 | Lee et al. | 137/13 |
| 5,164,429 | 11/1992 | Brazelton et al. | 523/322 |
| 5,284,627 | 2/1994 | Brazelton et al. | 422/135 |

FOREIGN PATENT DOCUMENTS

| | | | |
|---|---|---|---|
| 50312 | 4/1982 | European Pat. Off. | 3266 165.1 |

*Primary Examiner*—Tony G. Soohoo

*Attorney, Agent, or Firm*—Frank G. Morkunas

[57] ABSTRACT

An improved mixing device for combining two virtually immiscible substances. The device has a first inlet section for receiving a first substance, a second inlet section for receiving a second substance, a coupling structure to couple the first inlet section to the second inlet section, a mixing and expansion chamber adjacent to a first nozzle on the first inlet section for mixing the two substances conveyed to the mixing and expansion chamber, and a second coupling structure to couple the first inlet section to the second inlet section by way of a recirculation loop for further mixing and final discharge of the mixed substances.

14 Claims, 1 Drawing Sheet

MIXING UNIT

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improvement in mixing units, and more particularly to mixing units for combining various virtually immiscible substances such as polyelectrolyte materials, polymers, gums, and like flocculants and coagulants with water while maintaining the integrity of the substance to the greatest extent possible. Such flocculants and coagulants, including polymers and the like, are used, among other things, in water and waste-water treatment processes as an aid in removing fine particles from water, for removing other undesirable particles from water, for de-watering sludges, and for other liquid-solid separations.

There are several types of polymers used for this purpose. These include emulsion, solution, and mannich. Each generally have a low to high charge and a low to high molecular weight. The emulsion-type contains about 35–55% solids (polymers) in solution (oil) whereas the solution-type contains about 3% polymer. Each of these polymers require hydration into a homogeneous solution for activation before being introduced into a treatment process for effective treatment. Emulsion-type polymers are best suited because of their high polymer concentration. Optimum hydration and activation occurs when the polymer is fully hydrated into a homogeneous solution while maintaining its long-chain integrity. The most difficult polymer to hydrate into such a homogeneous solution and to properly activate is the emulsion-type polymer.

Polymers, particularly in the emulsion-type above described, are generally tightly tangled, long, thin, fragile strands or chains of molecules. To attain optimum treatment performance from the polymers, they should be mixed with water into a homogeneous solution. The mixing process must untangle the chains without breaking them thereby maintaining polymer integrity. Any such breaking or chopping prevents full homogenation and reduces the effectiveness of the polymer. Complete homogenation while maintaining polymer integrity is difficult to achieve because when the polymer engages the water, within milliseconds the tangled chains begin to loosen, unwind, and extend. The polymer molecules swell many times their original size. As the water penetrates the entangled chains, the molecules or particles at the outside layers of the entangled chain only partially dissolve and attain a sticky or adhesive quality. In this condition, if the sticky particles come into contact with other similar particles, they will agglomerate into clumps and inhibit further untangling. These clumps can range is size from microscopic to macroscopic. Once this occurs, the further dilution process slows down substantially. To further dissolve or break up these agglomerations, additional agitation is required. With this additional agitation, the molecules or particles at or near the surface of the agglomerated particle will go into solution first. Once dissolved and fully extended they become more fragile and are at greater risk of being chopped into shorter lengths. Shorter length polymers in water are of substantially decreased effectiveness.

Fully activated flocculated polymers are usually long, thin, fragile strands that are stretched out and swollen in water. The strands each have thousands if not millions of chemically active sites which are usually negative along their length. Tiny dirt particles in water generally have positively charged sites. As a positively-charged dirt particle contacts a negatively-charged polymer site, the dirt particle attracts to and clings to the polymer site in a magnet-like fashion. After the dirt particles have saturated all the polymer sites of the polymer chain, the polymer chain sinks or settles to the bottom bringing with it, the dirt particles. The water is, thereby, clarified. Longer polymer chains work better because, by their length and greater number of charged sites, they attract more dirt particles, the more quickly increase the overall weight of the chain in the process, and thereby more quickly sink and clarify the water.

The optimum mixing process requires a thorough dilution of the emulsion polymers into highly activated and uniformly diluted polymer solutions. This is best done by rapidly blending small quantities of concentrated polymer with large volumes of water. The more rapid the mixing, the better to produce a consistent flow of homogeneous diluted polymer of significant chain integrity, free of agglomerates, and free of smaller broken chains. Such rapid blending will ensure polymer integrity, eliminate molecular chopping of the chain, and will hydrate and activate the polymer in the shortest possible time to achieve maximum coagulation and flocculation properties.

Conventionally polymers are mixed by a wide variety of mixing units most of which are complex structures. These structures, by their complexity are also costly to purchase, operate, and maintain. They generally are larger units taking up precious space. There exists a need for a simple polymer activation device which has a small footprint; is inexpensive to manufacture, operate, and maintain; is relatively free of moving parts; and is capable of mixing into a homogenous solution emulsion-type polymers with dilution water while maintaining polymer integrity Several polymer mixing units are found in U.S. Pat. Nos. 5,018,871, 5,164,429, and 5,284,627, all to Brazelton, et.al. Each of these units are suited for the intended purpose and perform well but lack that simplicity necessary in most mixing operations. They are costly devices which enjoy a large footprint. The present invention is simple in structure and efficient and effective in purpose. It provides a low cost mixer which mixes polymer with water rapidly, virtually at point of entry, for a homogenous solution. No external power source is required to operate the present invention; operation results from the pressure of the water and polymer being introduced into the device. Mixing results are virtually immediate thereby virtually eliminating chopping and clumping. Adjustments to mixture results are made by increases in relative pressures at the intake points. Because mixing results are virtually immediate, there is better control of the mixing process and adjustments are also virtually immediate. Waste is eliminated and polymer activation is maximized.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a device for mixing virtually immiscible substances. The device has a first inlet means for receiving a first substance, a second inlet means for receiving a second substance, a coupling means to couple the first inlet means to the second inlet means, a mixing and expansion chamber adjacent to a first nozzle on the first inlet means for mixing the two substances conveyed to the mixing and expansion chamber, and a second coupling means to couple the first inlet means to the second inlet means by way of a recirculation loop for further mixing and final discharge of the mixed substances.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
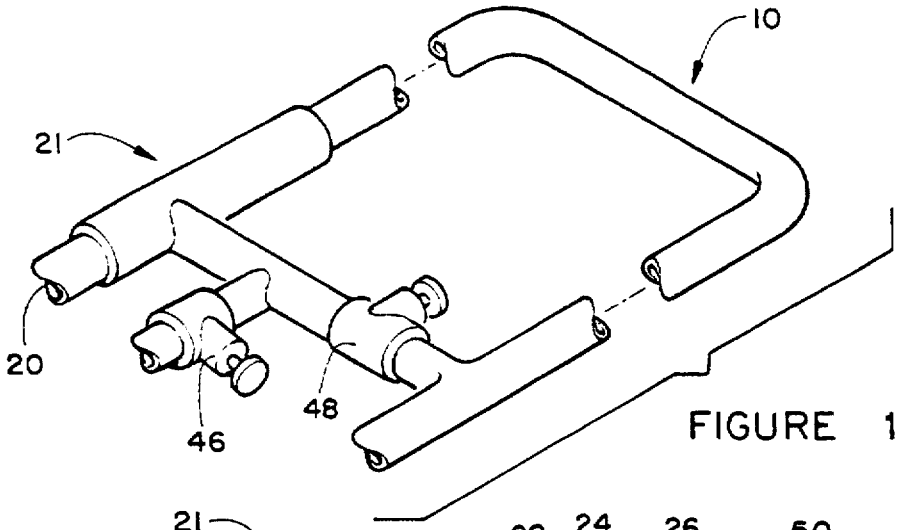
FIG. 1 is perspective partial view of the mixing unit.

Referring now to the drawings in detail and in particular to FIG. 1, reference character 10 generally designates the mixing unit constructed in accordance with a preferred embodiment of the present invention. A first inlet 20 provides the means by which a source substance enters the unit. The source substance generally is fed into the first inlet 20 under pressure directly into the first inlet 20 under external pressure. The first inlet 20 should be in direct alignment with the external pressure source and the external pressure flow. The amount of pressure can range from about 40 psi to about 120 psi. The source substance follows the direction denoted by the letter A. Source substance passes through a jet pump 21 first by entering first outlet nozzle 22 the walls of which are substantially angled inward. Such angles can range from about 2 degrees to about 45 degrees. For optimum performance, however, the angle should range from about 5 degrees to about 10 degrees. The pressure and force increases until the release of source substance through first orifice 24 and into the expansion chamber 26 (also referred to as the first chamber) adjacent thereto.

The wall of expansion chamber 26 are substantially angled outward as expansion chamber 26 extends toward the first discharge 28 up to the circulation loop 50 until the walls of expansion chamber connect with the circulation loop. This section is in direct alignment with the first inlet 20. Through the assembly portion 51, the circulation loop 50 substantially loops around and couples to a final discharge 56, a return discharge 52, a return line 54, the second inlet 40 to the jet pump 21, and to the first inlet 20. The release of source substance from first outlet nozzle 22 into the expansion chamber 26 creates a vacuum adjacent to the expansion chamber orifice 27 (also referred to as the first chamber orifice). Expansion chamber orifice 27 substantially circumscribes annularly first orifice 24 and can be level with first orifice 24 or substantially distal therefrom extending toward first inlet 20. The vacuum so created fosters a suction chamber 32 in an area substantially between first orifice 24 and second inlet 40. The area adjacent to the first orifice, but below the expansion chamber 26, is referred to as the suction inlet 30.

While the source substance is released into the circulation loop 50, a target, or second, substance is conveyed into the circulation loop 50 through the second inlet 40 through second outlet nozzle 42 attached thereto and out second orifice 44. The second inlet 40 is located upstream of the first inlet 20. The section connecting the two thereat is a first coupling. The conveyance downstream of the first discharge 28 causing re-circulation and connecting at a point upstream of and adjacent to the second inlet 40 is a second coupling. The walls of second outlet nozzle 42 are angled substantially inward and toward each other forming a annular opening at second orifice 44 from which the target substance emanates. Such angles can range from about 1 degrees to about 89 degrees. For optimum performance, however, the angle should range from about 5 degrees to about 45 degrees. The target substance enters the circulation loop 50 under outside pressure from a source (not shown) emanating from the second outlet 40. Entry of the target substance is also aided by the recirculation of substances through the circulation loop 50 by way of the return line 54, by the vacuum and suction created at the expansion chamber orifice 27, and by the suction chamber 32.

Target substance enters the expansion chamber 26 substantially simultaneously with source substance and at high pressures and velocities. The combination of the expansion chamber qualities, the velocities, and pressures created cause a substantial turbulence for each substance such that the two substances become rapidly mixed in the expansion chamber 26. In the case of polymer mixing with water, the strand or chain is better preserved and polymer activation is virtually immediate. Continued mixing and stabilization occurs throughout the circulation loop 50. The mixed substances are carried out of circulation loop 50 through the final discharge opening (also referred to as final discharge) 56. Some of the mixed substances are re-conveyed by the return discharge 52 through the return line 54 back to the expansion chamber 26. This complete recirculation augments the capture of target substances entering the mixing unit at the second inlet 40 and substantially pre-mixes the target substance with the mixed substances prior to entry into the expansion chamber and commingling and co-mixing with the source substance.

For less soluble, more immiscible substances such as polymers with water, pre-sizing the second orifice 44 enhances emulsion and mixing. To ensure that the injected polymer is carried rapidly and directly into the jet pump 21, the cross-sectional area of the second orifice 44 should be sized in proportion to the cross-sectional area of the return line 54 of between about 1:50 and 1:300. The ideal ratio between these respective cross-sectional areas is between about 1:70 and 1:150. This permits polymer molecules to enter the circulation loop 50 from the second orifice 44 in a virtually unbroken stream thereby further augmenting polymer integrity and activation.

The size of circulation loop 50 as to lineal length and diameter can vary depending on the types of substances to be mixed, their respective viscosities and other physical characteristics; and the number or passes or re-circulations desired. A ratio between diameter to length, D:L, of between about 1:10 to about 1:100 performs an adequate mixing of substantially immiscible substances. Mixing performance is better with a ratio of about 1:15 to about 1:40. Best results are achieved with a ratio of about 1:25.

Figure 2:
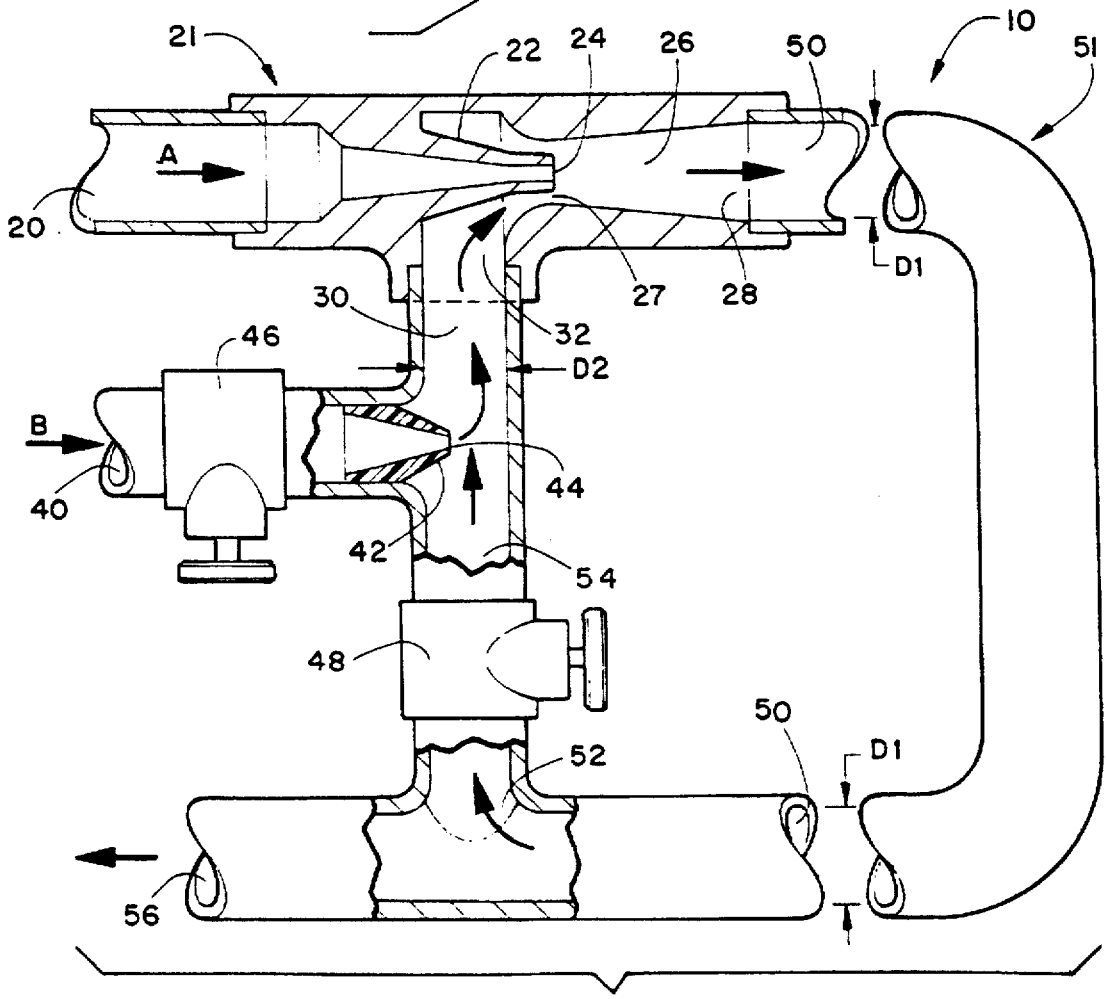
FIG. 2 is cut-away planar view of the mixing unit.

Regardless, diameters on the circulation loop 51 represented by D-1 on FIG. 2 should be the same from about the first discharge 28 to the final discharge 56. Diameter represented by D-2 on FIG. 2 may be less. This portion runs from about return discharge to the suction chamber 32 in the return line 54 of the recirculation loop 50.

It has been found that substantially flexible walls on second inlet 42 permits smaller sizing of second orifice 44 and further enhances the more efficient release of target substance particles through the second orifice 44 into the circulation loop 50; particularly for polymers. The flexibly walls further aid in maintaining polymer integrity. This further enhances the mixability of the two substances. The jet pump 21 can also be sized differently or re-configured to accommodate substances of completely immiscible types and viscosities. Such a re-configuration includes the use of a second injector for the target substance. The second injector is placed adjacent to the jet pump 21 annularly surrounding the jet pump 21 such that mixing of the source and target substances occurs immediately upon injection of the target substance into the mixing unit.

For control of the target substance and to prevent uncontrolled release of the target substance into the mixing unit, a spring-loaded check valve 46 can be placed at any point on the second inlet 40 distal to the return line 54. The check valve can be manually operated or automatically operated by use of a spring-loaded valve.

To control the flow of mixed substances through the circulation loop 50 and the return line 54 an incremental shut-off return valve 48 can be placed at any intermediate location between the second inlet 40 and the return discharge 52. In the completely off-position, the effect on the mixing unit would be an increase in vacuum pressure in the area substantially between the jet pump 21 and the valve. Varying the on-off positions of the valve between minimal degrees of flow restriction, but short of full on, and maximum degrees of flow restriction, but short of full off (from about 1% off to about 99% off), the concentration of target fluid could be adjusted to suit the mixing needs of the user or to create cavitation in the expansion chamber 26 to further augment the mixing potential of the mixing unit.

To sum up, the improved mixing unit provides a better, less expensive, minimal maintenance vehicle for mixing difficult-to-mix substances quickly and efficiently. It is simply comprised. Any conventional jet pump generally will suffice coupled with piping, two inlets, and one final discharge. Ratio sizing, valves, and wall flexibility enhance its capabilities. The simplicity of this unit, however, belies its efficiency and novelty.

The present disclosure includes that contained in the present claims as well as that of the foregoing description Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. A mixing device for mixing polymers with other substances introduced by external pressure into said mixing device, said mixing device comprising:

a. first inlet means adjacent to and in direct alignment with an external pressure source for receiving a first substance, said first inlet means having a first outlet nozzle and a first outlet orifice;

b. second inlet means for receiving polymer to be mixed with said first substance, said second inlet means having a second outlet nozzle and a second outlet orifice;

c. first coupling means to couple said first inlet means to said second inlet means such that said first coupling means is located directly between said first outlet nozzle and said second outlet orifice and further defines a suction chamber therebetween, said suction chamber being directly adjacent to said first outlet nozzle;

d. a first chamber adjacent to and in direct alignment with said first outlet nozzle for receiving said first substance and said polymer and for mixing said first substance therein with said polymer, said first chamber having a first chamber orifice, for introducing said polymer by suction from said suction chamber into said first chamber, and a first discharge for discharging said first substance and said polymer after they have been mixed thereby producing a first mixed substance; and e. second coupling means to couple said first inlet means to said second inlet means, said second coupling means comprising:

(1) a loop having a first end and a second end wherein said first end is connected to said first discharge and is downstream of and in direct alignment with said first inlet means, (2) a return discharge having a final discharge opening and a return opening, said return discharge connected to said second end of said loop, and (3) a return line connected to said first inlet means and to the return opening of said return discharge, whereby introduction under external pressure of said first substance into said first inlet means creates a suction within said suction chamber and thereby draws said polymer from said second inlet means into said first chamber for mixing and expels said first mixed substance into said loop for stabilizing of the first mixed substance and for discharge from the mixing device through the final discharge opening or for re-circulation of the first mixed substance through the mixing device through the return opening, the return line, the first inlet means, the suction chamber, the first chamber, and into the loop.

2. The device as defined in claim 1 wherein said first outlet nozzle has substantially inwardly angled walls extending to said first orifice.

3. The device as defined in claim 1 wherein said first chamber has substantially outwardly angled walls extending substantially from said first orifice substantially to said first discharge.

4. The device as defined in claim 1 wherein said second outlet nozzle has substantially inwardly angled walls extending to said second outlet orifice.

5. The device as defined in claim 1 wherein said second outlet nozzle is substantially flexible.

6. The device as defined in claim 1 wherein said second outlet orifice is sized in proportion to said return line such that a ratio between their respective cross-sectional areas is between about 1:50 and 1:300.

7. The device as defined in claim 1 wherein said second outlet orifice is sized in proportion to said return line such that a ratio between their respective cross-sectional areas is between about 1:70 and 1:150.

8. The device as defined in claim 1 where a return valve is connected to said return line intermediate to said second inlet and said return discharge.

9. The device as defined in claim 1 wherein said first outlet orifice is located in said first chamber orifice.

10. The device as defined in claim 1 wherein a check valve is connected to said second inlet adjacent to said return line.

11. The device as defined in claim 1 wherein said circulation loop has a substantially co-equal inner diameter originating substantially from said first discharge continuing substantially to said final discharge opening.

12. The device as defined in claim 11 whereby said circulation loop has a length and a circulation-loop-diameter to circulation-loop-length ratio from about 1:10 to about 1:100.

13. The device as defined in claim 11 whereby said circulation loop has a length and a circulation-loop-diameter to circulation-loop-length ratio from about 1:15 to about 1:40.

14. The device as defined in claim 11 whereby said circulation loop has a length and a circulation-loop-diameter to circulation-loop-length ratio of about 1:25.

* * * * *